US010561483B2

(12) United States Patent
Funk

(10) Patent No.: US 10,561,483 B2
(45) Date of Patent: Feb. 18, 2020

(54) TILTABLE CART

(71) Applicant: Inguran, LLC, Navasota, TX (US)

(72) Inventor: Ted L. Funk, Savoy, IL (US)

(73) Assignee: Inguran, LLC, Navasota, TX (US)

( * ) Notice: Subject to any disclaimer, the term of this patent is extended or adjusted under 35 U.S.C. 154(b) by 0 days.

(21) Appl. No.: 15/720,879

(22) Filed: Sep. 29, 2017

(65) Prior Publication Data

US 2019/0099250 A1 Apr. 4, 2019

(51) Int. Cl.
*A61D 3/00* (2006.01)
*A61G 1/02* (2006.01)

(52) U.S. Cl.
CPC ..... *A61D 3/00* (2013.01); *A61G 1/0243* (2013.01)

(58) Field of Classification Search
CPC ..... B66F 7/065; B66F 7/243; A61G 7/1011; A61G 7/1036; A61G 7/1046; A61G 7/1057; A61G 2007/0518; A61G 7/0518; A61G 1/0243; A61D 3/00
USPC ..... 254/93 R; 5/83.1, 86.1; 280/651; 119/843
See application file for complete search history.

(56) References Cited

U.S. PATENT DOCUMENTS 5,072,960 A * 12/1991 Sperko ..... B62B 3/04 16/35 D
6,701,554 B2 * 3/2004 Heimbrock ..... A61G 13/06 5/600
6,860,495 B2 3/2005 Williamson
7,922,183 B2 * 4/2011 Figel ..... A61G 1/0225 280/47.38
8,155,918 B2 * 4/2012 Reed ..... A61G 1/013 5/600
8,505,137 B1 * 8/2013 Gaines, Jr. ..... A61B 6/0457 108/147
2006/0213007 A1 9/2006 Palay et al.
2009/0123260 A1 * 5/2009 Howard-Leicester .... B60P 3/07 414/475
2010/0138990 A1 * 6/2010 Van Oirschot ..... A61G 7/1011 5/86.1
2013/0193392 A1 * 8/2013 McGinn ..... B66F 7/065 254/93 R

FOREIGN PATENT DOCUMENTS

CN 1973797 A 6/2007

* cited by examiner

*Primary Examiner* — Paul N Dickson
*Assistant Examiner* — Hilary L Johns
(74) *Attorney, Agent, or Firm* — Ryan Christensen; Hashim Rahman

(57) ABSTRACT

The invention generally encompasses an animal cart system for safely carrying, transporting and offloading an animal from an examination or surgery area to a recovery area, the cart system comprising a floor cart, the floor cart comprising an upper platform having rails, a lower platform, an actuator secured to the upper platform and the lower platform, and a pivoting connection coupled to the upper platform and the lower platform that tilts the upper platform in response to the actuator, and an examination cart slidably and releaseably coupled to the upper platform.

9 Claims, 4 Drawing Sheets

TILTABLE CART

BACKGROUND OF THE INVENTION

In the animal care and husbandry fields, in order to carry out health maintenance tasks and administer various surgical and non-surgical medical procedures and diagnostic tests, there is a need to carry large animals, including livestock, from examination or treatment areas to recovery areas. With respect to livestock in particular, it is difficult to safely and efficaciously move an animal from a surgical or examination table or area, for example, to a recovery area while the animal is sedated or anesthetized. Thus, there is a need in the animal care and husbandry fields to safely and efficaciously transport large animals.

SUMMARY OF THE INVENTION

The invention generally encompasses an animal cart system for safely carrying, transporting and offloading an animal from an examination or surgery area to a recovery area. Examinations and veterinary procedures, including surgical procedures, can be conducted on the animal cart system itself. Once such examination or procedure is completed, the cart system can be used to safely transport and offload the animal to a recovery area.

One embodiment of the invention comprises a cart system comprising a floor cart, the floor cart comprising an upper platform having rails, a lower platform, an actuator secured to the upper platform and the lower platform, and a pivoting connection coupled to the upper platform and the lower platform that tilts the upper platform in response to the actuator, and an examination cart slidably and releaseably coupled to the upper platform. In certain embodiments, the examination cart has a plurality of wheels spaced for engaging the rails of the upper platform. The cart system can further comprise a ramp having parallel rails, wherein the height and the angle of the ramp are matched to an angle of the upper platform in a tilted position. In a further embodiment, the lower platform can further comprise a plurality of caster wheels. In yet another embodiment, the lower platform can further comprise pivot pillow blocks. In another embodiment, the upper platform can further comprise a caster stop.

In some embodiments of the invention, the actuator may comprise a pneumatic (i.e., gas) or hydraulic cylinder. In other embodiments, the actuator may comprise an electric motor.

Another embodiment of the invention comprises a cart system comprising a floor cart, the floor cart comprising an upper platform having rails, a lower platform, an actuator secured to the upper platform and the lower platform, and an examination cart slidably and releaseably coupled to the upper platform. In a further embodiment, the floor cart may comprise at least two actuators. In a yet further embodiment, the at least two actuators may each further comprise a pivoting connection to the upper platform and/or the lower platform. In an even further embodiment, the at least two actuators operate to tilt the upper platform at an angle. In another embodiment the at least two actuators tilt the upper platform lengthwise, i.e., along its longitudinal axis. In certain embodiments, the examination cart has a plurality of wheels spaced for engaging the rails of the upper platform. The cart system can further comprise a ramp having parallel rails, wherein the height and the angle of the ramp are matched to an angle of the upper platform in a tilted position. In a further embodiment, the lower platform can further comprise a plurality of caster wheels. In some embodiments, the ramp is portable. In yet another embodiment, the lower platform can further comprise pivot pillow blocks. In another embodiment, the upper platform can further comprise a caster stop.

Another embodiment of the cart system comprises a rope tethered to the examination cart and a floor cart comprising a rope snubber for controlling the descent of the examination cart when unlocked and in a tilted position.

Yet another embodiment of the cart system comprises an examination cart or an upper platform with a wheel locking mechanism to prevent the examination cart from moving when in a tilted position.

DETAILED DESCRIPTION OF THE INVENTION

Figure 1:
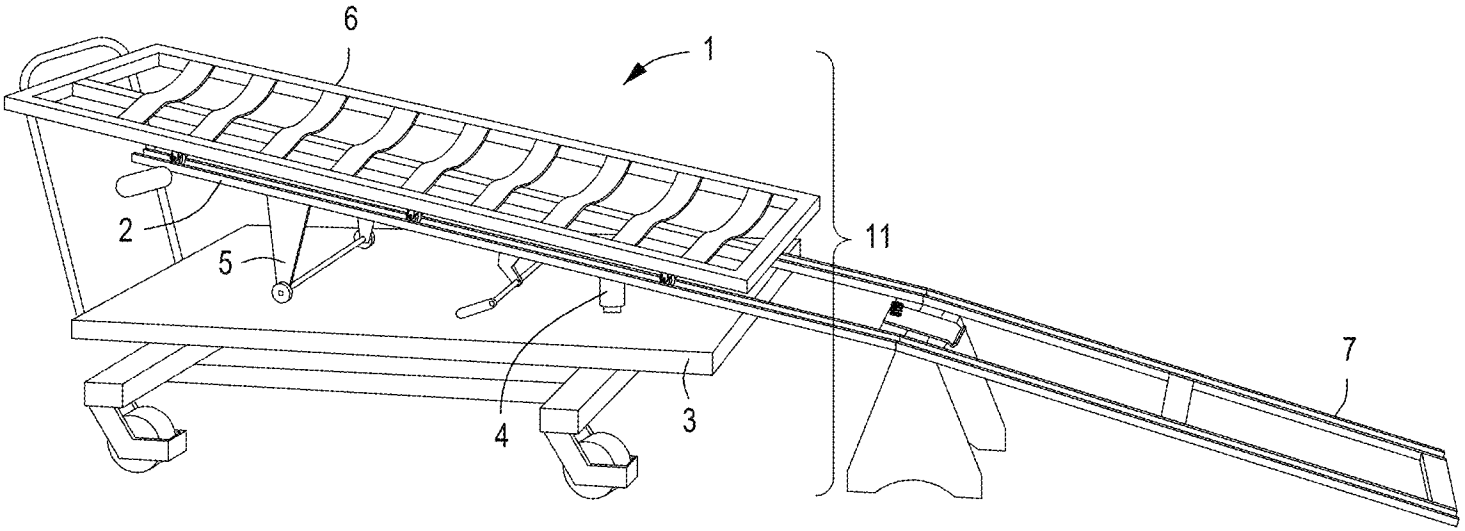
FIG. 1 is a depiction of one embodiment of a cart system of the invention.

FIG. 1 shows an embodiment of the invention comprising a cart system 1. In this embodiment, the cart system 1 comprises i) a floor cart 11, the floor cart 11 comprising an upper platform 2, a lower platform 3, an actuator 4 and a pivoting connection 5 and ii) an examination cart 6; and an offloading ramp 7. In certain embodiments, the cart system 1 is capable of carrying animals, including swine, weighing from 1000-2000 lbs.

Figure 2:
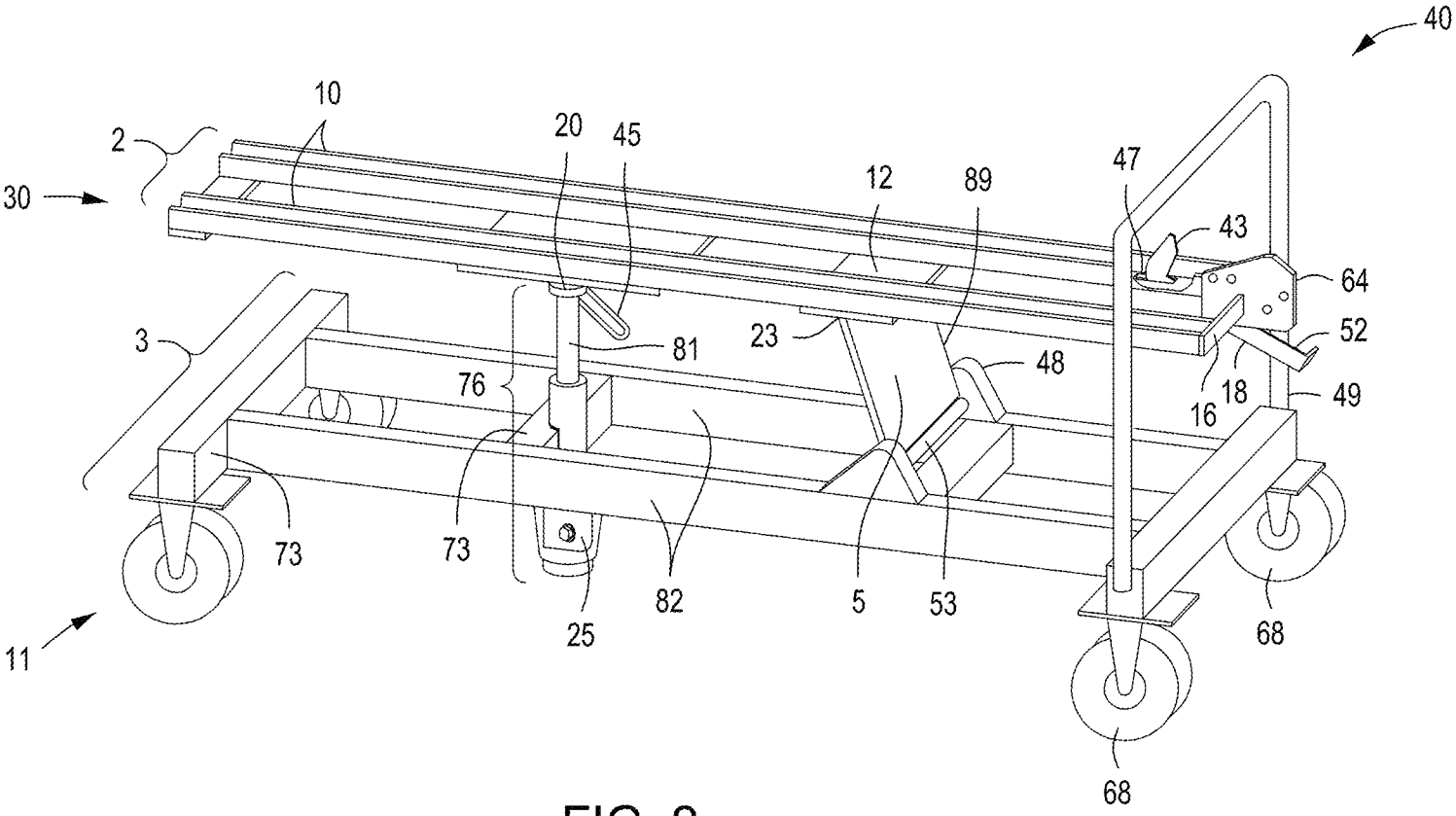
FIG. 2 is a depiction of a floor cart of the invention.

Referring to FIG. 2, which depicts an embodiment of floor cart 11, the upper platform 2, is comprised of a pair of rails 10 that interface with wheels 21 of examination cart 6. The rails 10 are parallel to one another and are joined to one another with one or more struts (or plates) 12 oriented perpendicular to rails 10. In one embodiment, the rails 10 are constructed from c-channel members. The upper platform 2 is comprised of a cylinder end 30 and a pivot end 40. The cylinder end 30 is comprised of an upper cylinder pivot 20 that is coupled to one end of pneumatic cylinder 81 and to the upper platform 2 by attachment to a strut (or plate) 12. The pivot end 40 comprises one or more pivoting connection contact points 23 where one or more pivoting connection plates 89 that comprise pivoting connection 5 are attached. Pivoting connection 5 is connected to struts (or plates) 12) via pivoting connection plates 89 (or in another embodiment, not depicted, to rails 10). The pivot end 40 further comprises a caster stop 16, which prevents examination cart caster wheels 21 of examination cart 6 from rolling off of the pivot end 40 of upper platform 2. The caster stop 16, in one embodiment, comprises a vertically oriented wall that is perpendicular to rails 10. The upper platform 2 further comprises a wheel locking mechanism 18 comprised of a pivoting lever 52 with an end 43 that protrudes through space 47 in one of the rails 10, thereby preventing wheels 21 on examination cart 6 from rolling when cylinder end 30 of platform 2 is lowered. Upper platform 2 also comprises a rope snubber 64 which allows the user to lower the examination cart 6 in a controlled manner when the upper platform 2 is tilted downward.

Referring to FIG. 2, the floor cart 11 further comprises an actuator 76. The actuator in the embodiment shown is comprised of a pneumatic cylinder 81 and a release lever 45. Actuation of release lever 45 causes pneumatic cylinder 81 to compress if sufficient force is applied to the pneumatic cylinder 81 in a downward direction parallel to the vertical axis of pneumatic cylinder 81. Conversely, actuation of release lever 45 causes pneumatic cylinder 81 to expand when sufficient force is applied in an upward direction parallel to the vertical axis of pneumatic cylinder 81. In one embodiment, pneumatic cylinder 81 is comprised of a locking gas spring having a 125 mm stroke length cylinder rated at approximately 320 lbs. In alternative embodiments, not shown, a hydraulic cylinder or an electric motor can be used instead of pneumatic cylinder 81.

Referring to FIG. 2, lower platform 3 of floor cart 11 is comprised of two parallel members 82. The parallel members 82 are coupled to one another via a series of perpendicularly-arrayed cross-members 73. Lower platform 3 further comprises at least three lower platform caster wheels 68 that support cart system 1 and are attached to cross-members 73 or in an alternative embodiment (not shown) to the two parallel members 82. In some embodiments (not shown), one or more lower platform caster wheels 68 comprise a brake mechanism to ensure that cart system 1 does not move during use. In one embodiment, the cross-members 73 are telescoping cross-members, thus allowing the user to adjust the width of lower platform 3 as necessary. In some embodiments, telescoping cross-members 73 have holes drilled along their length (not shown) to accommodate safety pin width setting. The lower platform 3 also comprises at least two pivot pillow blocks 48 coupled to parallel members 82, or in another embodiment (not depicted) to one of the cross members 73. A pivoting connection axle 53 is rotatabaly connected to pivot pillow blocks 48 and is also coupled to the one or more pivoting connection plates 89. Lower platform 3 further comprises a lower cylinder pivot 25 that is coupled to one end of pneumatic cylinder 81 and to the lower platform 3 by attachment to a cross-member 73. Pivoting connection 5 tilts the upper platform 2 in response to movement of the actuator 76. The lower platform 3 also comprises a handle 49 that is generally vertically oriented and allows the user to apply directional force to the cart system 1 and thereby position cart system 1 using the lower platform caster wheels 68. In one embodiment, the length of upper platform 2 is substantially identical to the length of lower platform 3.

Figure 3:
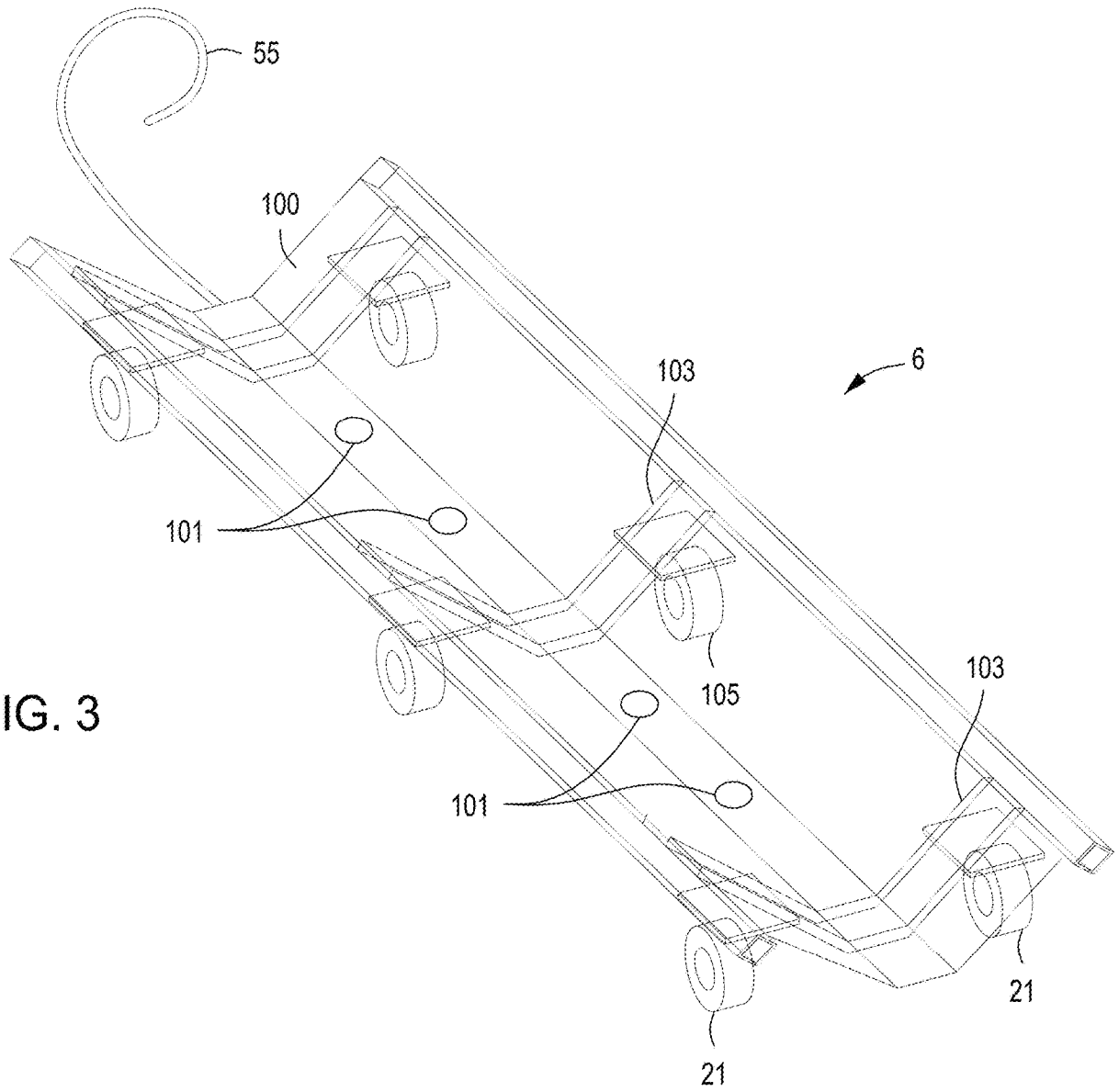
FIG. 3 is a depiction of an examination cart of the invention.

FIG. 3 depicts one embodiment of examination cart 6 of cart system 1. Examination cart 6 is comprised of a cradle portion 100 that has a v-shaped or u-shaped cross-sectional profile to accommodate a supine animal, such as a sow. The cradle portion 100 may also comprise drainage holes 101 to allow drainage of fluids. The cradle portion 100 is supported by at least two examination cart struts 103, which substantially conform to the cross-sectional profile of the cradle portion 100. In the embodiment shown in FIG. 3, the examination cart 6 has an examination cart swivel caster wheel 21 at each corner of the examination cart, each examination cart swivel caster wheel 21 rotatably coupled to an examination cart strut 103 at both ends of the examination cart 6. In this embodiment, the examination cart 6 may also comprise an additional examination cart strut 103 located centrally between the two examination cart struts 103 to which each examination cart swivel caster wheel 21 is coupled. To this centrally located examination cart strut 103, rigid (i.e., non-swiveling) caster wheels 105 may be attached. In one embodiment, the width between examination cart swivel caster wheels 21 and the width between rigid caster wheels 105 is substantially identical to the width between rails 10 of upper platform 2. In a further embodiment, the width of each examination cart swivel caster wheel 21 and the width of each rigid caster wheel 105 is smaller than the width of the c-channel members comprising rails 10 so that the examination cart swivel caster wheels 21 and the rigid caster wheels 105 fit within the c-channel of rails 10. The examination cart 6 further comprises a rope 55, which is coupled to the examination cart 6 at one end of rope 55. The other end of rope 55 is fed through rope snubber 64 so that the user can manually lower the examination cart 6 in a controlled manner when the upper platform 2 is tilted downward and the wheel locking mechanism 18 is disengaged.

Figure 4:
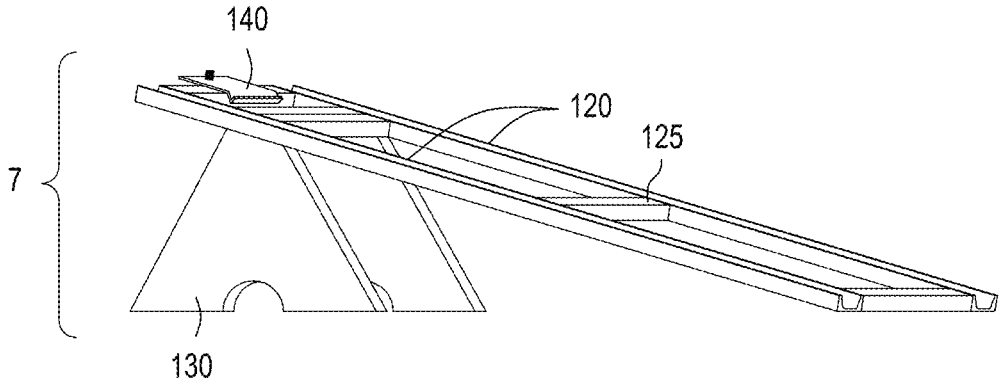
FIG. 4 is a depiction of an offloading ramp of the invention.

Referring to FIG. 4, the offloading ramp 7 is comprised of two ramp rails 120 that substantially conform to the width between the rails 10 of upper platform 2, as well as two or more ramp struts (or ramp plates) 125 arrayed between ramp rails 120. Offloading ramp 7 further comprises one or more elevation members 130, which maintain the ramp rails 120 at a fixed height. In one embodiment, the ramp rails 120 are at a height that substantially matches the height of rails 10 when the upper platform is tilted downwards. In a particular embodiment, the ramp rails 120 are at a height that substantially matches the height of rails 10 when the upper platform is tilted downwards to its lowest possible position, i.e., the cylinder end 30 is as low as it can go relative to the pivot end 40 of upper platform 2. Offloading ramp 7 also comprises a spring latch mechanism 140, which reversibly couples the offloading ramp 7 to the upper platform 2 in order to keep rails 10 vertically and/or horizontally aligned with ramp rails 120 during the offloading process so that the examination cart swivel caster wheels 21 and the rigid caster wheels 105 of examination cart 6 do not "run off track."

In certain embodiments, the invention encompasses a method of transporting an animal from a surgical or examination area to a recovery area. First, the animal is lifted using an animal lift such one disclosed in U.S. application Ser. No. 15/187,966, the disclosure of which is hereby incorporated by reference in its entirety. After the animal is sedated or anesthetized, the animal is transferred from the animal lift to the examination cart 6, which is in a locked and reversibly coupled position on top of the upper platform 2 (i.e., examination cart swivel caster wheels 21 and the rigid caster wheels 105 of examination cart 6 are within the c-channel members of rails 10 and wheel locking mechanism 18 is engaged). Prior to transfer of the animal, the upper platform 2 is in a substantially horizontal position relative to the floor. The animal is transferred to the examination cart 6 so that it is in the supine position on the examination cart 6 and so that the head of the animal is towards the cylinder end 30 of upper platform 2. Once the animal is on the examination cart 6, it can be examined or operated on at that location or alternatively be transported on the cart system 1 by the user using handle 49 to a different location for examination or to be operated on. If necessary for the examination or the surgery, the animal's head can be lowered, using the release lever 45 of actuator 76, to place the animal in the Trendelenburg position. In certain embodiments, a desired head-down-tilt is approximately 10 degrees from horizontal. Once the examination or surgery is complete, the animal can be offloaded to the ground of a recovery area by tilting the upper cart 2, if necessary, so that the rails 10 substantially align with ramp rails 120 of offloading ramp 7. Thereafter the spring latch mechanism 140 of the offloading ramp 7 can be engaged to couple the offloading ramp 7 to the upper platform 2 in order to keep rails 10 vertically and/or horizontally aligned with ramp rails 120 during the offloading process. Once the upper platform 2 and offloading ramp 7 are coupled, the user can hold on to rope 55 and disengage the wheel locking mechanism 18. Subsequently, the user can loosen his or her grip on rope 55 (which is threaded through rope snubber 64) so that the examination cart 6 gradually descends upper platform 2, onto offloading ramp 7 and finally onto the ground in a controlled manner. Thereafter the examination cart 6 can be positioned on the floor by the user and the animal safely offloaded. Once the animal is off loaded and the examination cart 6 is replaced on rails 10 of upper platform 2, release lever 45 is actuated again and the tilted rails 10 will come back to a horizontal position.

In one embodiment of the invention, the rails 10 of upper platform 2 are approximately 62 inches in length and are spaced approximately 11.5 inches apart (when measured from the outside of rails 10). In another embodiment of the invention, rails 10 are approximately 40-70 inches in length and are space approximately 8-16 inches apart (when measured from the center of each rail). Examination cart 6 is approximately 72 inches in overall length in one embodiment, and in another embodiment is approximately 50-90 inches in overall length. One of ordinary skill in the art will recognize that these general measurements can be adjusted according to the species of animal to be carried by cart system 1 or as required by the anticipated loads and required durability.

In certain embodiments of the invention, the cart system 1 is constructed substantially of metal, including but not limited to steel. In particular, in certain embodiments of the invention, certain components of the cart system 1, the upper platform 2, the lower platform 3, the actuator 4, the pivoting connection 5, the examination cart 6 and the offloading ramp 7 are constructed of steel of such metallurgical properties and manufactured to meet industry-accepted specifications for the anticipated loads and required durability. In other embodiments of the invention, other types of metals, including but not limited to aluminum and titanium, can used to construct the components of the cart system 1, according to the necessary load bearing properties needed for a particular application and as appropriate according to one of ordinary skill in the art. Similarly other materials such as fiberglass and plastics can be utilized in construction of certain components of the invention, as appropriate according to one of ordinary skill in the art.

Those of ordinary skill in the art will recognize that the invention described above includes many inventive embodiments and is not limited to any particular embodiment shown in the drawings or described above.

What I claim is:

1. A cart system comprising:

a floor cart comprising:

an upper platform having rails comprised of c-channel members;

a lower platform;

an actuator secured to the upper platform and the lower platform; and a pivoting connection coupled to the upper platform and the lower platform that tilts the upper platform in response to the actuator; and an examination cart slidably and releaseably coupled to the upper platform, the examination cart having a plurality of wheels, wherein the wheels are in engagement with the rails of the upper platform and fit within the c-channel members so as to permit the examination cart to be rolled completely off of the upper platform.

2. The cart system of claim 1, further comprising a ramp having parallel rails.

3. The cart system of claim 1, the actuator comprising a pneumatic or hydraulic cylinder.

4. The cart system of claim 1, the lower platform further comprising a plurality of caster wheels.

5. The cart system of claim 1, the lower platform further comprising pivot pillow blocks.

6. The cart system of claim 1, wherein the cart system is capable of carrying animals weighing from 1000-2000 lbs.

7. The cart system of claim 1, wherein the upper platform is capable of a downward tilt that is 10 degrees or greater from horizontal.

8. The cart system of claim 1, the examination cart further comprising a cradle, wherein the cradle has a cross-sectional profile that is substantially v-shaped or u-shaped.

9. The cart system of claim 1, wherein the plurality of wheels comprise swiveling and non-swiveling caster wheels.

* * * * *